US006301760B1

(12) United States Patent
Beard et al.

(10) Patent No.: US 6,301,760 B1
(45) Date of Patent: Oct. 16, 2001

(54) METHOD OF SELECTIVELY ALTERING PHYSICAL PROPERTIES OF AN ELASTANE FILAMENT

(75) Inventors: McDaniel L. Beard, Burlington; James Lowell Lawson, Greensboro; James R. Isbell, Summerfield, all of NC (US)

(73) Assignee: Guilford Mills, Inc., Greensboro, NC (US)

( * ) Notice: Subject to any disclaimer, the term of this patent is extended or adjusted under 35 U.S.C. 154(b) by 0 days.

(21) Appl. No.: 09/503,316

(22) Filed: Feb. 14, 2000

(51) Int. Cl.[7] ..... D02J 1/22

(52) U.S. Cl. ..... 28/240; 280/245; 280/246

(58) Field of Search ..... 28/240, 219, 220, 28/243, 172.2, 241, 242, 244, 245, 246; 264/288.4, 288.8, 290.5; 57/309, 310, 287, 288

(56) References Cited

U.S. PATENT DOCUMENTS

| | | | | |
|---|---|---|---|---|
| 3,476,850 | * | 11/1969 | Matsubayashi et al. | 28/240 |
| 3,703,753 | * | 11/1972 | Binford et al. | 28/248 |
| 3,831,231 | * | 8/1974 | Binford et al. | 28/220 |
| 3,905,076 | * | 9/1975 | Harris | 28/246 |
| 3,940,917 | * | 3/1976 | Strachan | 28/271 |
| 4,592,119 | | 6/1986 | Bauer et al. | 28/271 |
| 4,611,410 | | 9/1986 | Brossmer | 34/41 |
| 4,630,340 | | 12/1986 | Bauer et al. | 28/187 |
| 4,644,622 | | 2/1987 | Bauer et al. | 28/271 |
| 4,669,158 | | 6/1987 | Ballarati et al. | 28/172 |
| 4,669,159 | | 6/1987 | Bogucki-Land | 28/185 |
| 4,715,097 | | 12/1987 | Bogucki-Land | 28/172 |
| 4,791,187 | * | 12/1988 | Suling et al. | 264/328.8 |
| 4,852,225 | | 8/1989 | Hagewood et al. | 28/187 |
| 4,858,287 | | 8/1989 | Maurer et al. | 28/172 |
| 4,894,892 | | 1/1990 | Duda | 28/172 |
| 5,012,563 | | 5/1991 | Bogucki-Land | 28/172.1 |
| 5,066,447 | | 11/1991 | Knox et al. | 264/290.5 |
| 5,223,197 | | 6/1993 | Boles et al. | 264/103 |
| 5,333,364 | | 8/1994 | Enfield et al. | 28/172.2 |
| 5,407,621 | | 4/1995 | Collins et al. | 264/103 |
| 5,560,192 | | 10/1996 | Frith | 57/226 |
| 5,590,447 | | 1/1997 | Goineau | 28/172.1 |
| 5,644,825 | * | 7/1997 | Threlkeld et al. | 28/240 |
| 5,675,878 | | 10/1997 | Brown et al. | 28/271 |
| 5,682,656 | | 11/1997 | Lesley | 28/172.1 |
| 6,125,515 | * | 10/2000 | Boliek et al. | 28/190 |

OTHER PUBLICATIONS

Manmade Fiber Year Book (CFI), Second Issue, 1995, pp. 30–40.

* cited by examiner

*Primary Examiner*—Amy B Vanatta
(74) *Attorney, Agent, or Firm*—Kennedy Covington Lobdell & Hickman, LLP

(57) ABSTRACT

The physical properties of an elastane, i.e. spandex, filament may be selectively altered basically by stretching the filament to a selected degree while heating the filament to a selected temperature above its glass transition temperature to set the filament at a reduced denier and a reduced degree of elongation. The tenacity of the filament may increase or decrease depending upon variable parameters of the methodology. The method may be performed on a single elastane filament or simultaneously on multiple filaments, e.g., in a draw warping operation.

25 Claims, No Drawings

METHOD OF SELECTIVELY ALTERING PHYSICAL PROPERTIES OF AN ELASTANE FILAMENT

BACKGROUND OF THE INVENTION

The present invention relates generally to the production and processing of elastane filaments and, more particularly, to a method for selectively altering physical properties, especially denier, elongation and tenacity, of such filaments.

Elastane filaments, sometimes more commonly referred to in the textile industry as spandex filaments, are highly elastic synthetic fibers well known and commonly used throughout the textile industry, particularly for imparting a desired degree of elasticity to textile fabrics. As is well known, elastane filaments are essentially comprised of linear macromolecules primarily of segmented polyurethane, either polyetherurethane or polyesterurethane. Such elastane filaments are known to be produced by several differing spinning processes commonly referred to as dry spinning, wet spinning, reactive spinning and melt spinning.

Regardless of the precise chemical composition and the method of manufacture of an elastane filament, such filaments characteristically exhibit a very high degree of longitudinal elongation to breakage of several hundred percent, typically between four hundred and eight hundred percent of the relaxed longitudinal dimension of the filaments, with the ability to substantially completely recover from such elongation repeatedly (e.g. 95% to 98% recovery). Thus, as indicated, elastane filaments are uniquely and advantageously suited to use in textile fabrics, e.g., apparel fabrics, wherein a degree of stretchability is desirable to enhance the functionality and usability of such fabrics.

As used herein, the term "elastane" is accordingly intended to have the broadest interpretation and scope in accordance with conventional textile industry usage so as to encompass any and all filaments and fibers of the type afore-described, whether now known or subsequently developed. Reference may be had to the *Manmade Fiber Year Book* (*CFI*), Second Issue, 1995, at pages 30–40, for a more detailed technical description and understanding of elastane filaments and fibers, which work is incorporated herein for reference purposes.

Whether elastane filaments are produced by any of the known manufacturing processes of dry, wet, reactive or melt spinning, the physical properties of the filaments thusly produced are conventionally considered to be suitable for immediate use in textile fabric forming operations without the need for, or any perceived benefit from, subsequent processing. In contrast, with certain other types of extruded synthetic filaments used in the textile industry, most notably polyester and nylon, conventional wisdom and experience holds that, before such filaments are suitable for use in the manufacture of textile fabrics, manipulation of the physical characteristics of the filaments is necessary through a drawing operation, including heat setting in the case of polyester filaments, in order to improve and stabilize molecular orientation within the filaments. Such drawing and heat setting of polyester, nylon and like filaments is known to be performed either on a single filament, e.g., through a draw twisting or like process, or on multiple filaments simultaneously, e.g., in a so-called draw warping process predominantly utilized to prepare the filaments for use in weaving or warp knitting of a textile fabric.

Heretofore, drawing and heat setting of elastane filaments, whether performed on a single filament or multiple filaments, is not known to have been utilized or even attempted in the textile industry and it is believed that conventional wisdom holds that no particular benefits would result since, in contrast to polyester and nylon filaments, the molecular structure within such filaments is stable in the state of the filaments exiting the spinning process and the attendant physical characteristics of the filaments as so produced are already well suited to textile fabric applications without further processing.

SUMMARY OF THE INVENTION

In substantial contrast to the foregoing, it has surprisingly been discovered that elastane filaments will respond to a drawing and heat setting operation in manners which favorably enable the physical properties of such filaments to be altered and thereby selectively engineered, e.g., as may be desirable or even necessary to tailor such filaments to particular textile fabric applications. It is accordingly a basic object of the present invention to provide a novel method by which the physical properties of elastane filaments may be selectively altered and engineered. A more particular object of the present invention is to provide such a methodology by which elastane filaments may be engineered to modify the physical properties imparted by the conventional spinning processes and, in particular cases, to achieve properties in such filaments which may not normally be achieved through conventional spinning.

Briefly summarized, the method of the present invention contemplates the selective alteration of physical properties of an elastane filament basically by stretching the filament to a selected degree while heating the filament to a selected temperature above its glass transition temperature so as to cause the filament to become set at a reduced denier and a reduced degree of elongation. Typically and preferably, the elastane filament will be caused to travel longitudinally during performance of the present method, e.g., in a single filament drawing operation or in a multiple filament draw warping operation, wherein the uniformity of the stretching and heating imposed on the filament or filaments may be controlled via establishment of a uniform traveling speed.

Thus, by selective control of the degree of stretching imparted to the filament or filaments in coordination with selective control of the temperature to which the filament or filaments are heated and selective control of the traveling speed of the filament or filaments to determine a selected time interval over which the filament or filaments are exposed to the stretching and heating, it is possible to achieve a selective reduction in the denier of the elastane filament in conjunction with a selected reduction of its degree of elongation and, also, either a selected increase or decrease in the tenacity of the filament or filaments, depending upon the combination of processing parameters being utilized.

As persons skilled in the art will recognize, even a reduction of up to 50 percent of the degree of available elongation of an elastane filament to the point of breakage generally will not deleteriously affect the performance or usability of such filaments in textile fabric constructions because such filaments would still generally have a maximum degree of elongation in excess of one hundred to several hundred percent of the relaxed length. On the other hand, reduction of the denier of an elastane filament quite often will be highly desirable. As is known, the cost of spinning an elastane or any other synthetic filament generally increases substantially as the spun denier decreases because correspondingly fewer pounds of filament may be produced per hour. Thus, generally speaking, elastane filaments of higher denier are less costly to produce; however, since elastane filaments are typically used in combination with other non-stretchable or less-stretchable filaments or yarns for the purpose of imparting stretchability to the resultant fabric but not normally to add bulk or weight to the fabric, it is generally desirable to use elastane filaments of smaller deniers. Thus, the present invention enables these competing factors to be reconciled by enabling elastane filaments to be produced more economically and less costly at higher deniers and then to be selectively engineered to a reduced denier best suited to a given fabric application.

Broadly, it is believed that the range and combination of physical characteristics in an elastane filament achievable through the present invention is limited only by the practical minimum values of denier, tenacity and elongation the resultant filament or filaments must have to be functional in a textile fabric. In other words, it is believed that through the processing under the present invention of selectively differing elastane filaments (i.e., filaments made by differing spinning methodologies and having differing chemical compositions and/or molecular structures) using selectively differing combinations of the aforementioned parameters of degree of elongation, heat setting temperature and filament traveling speed and possibly other variables, i.e., differing drawing machinery, filaments having a virtually limitless combination of the physical properties of denier, elongation and tenacity may be produced.

By way of example but not intended to limit the scope of the present invention, it is contemplated that the present invention will enable elastane filaments to be selectively reduced in denier from about 10 percent to about 45 percent of their original denier prior to stretching and heat setting. Likewise, it is contemplated that the degree of elongation of elastane filaments may be selectively reduced in accordance with the present invention from about 5 percent to about 50 percent of their original degree of elongation prior to stretching and heating. The tenacity of elastane filaments, on the other hand, will be possible to be selectively increased or decreased in comparison to the original tenacity of such filaments prior to stretching and heating, depending upon the composition of the filament, degree of stretch, heated temperature, traveling speed, and other possible variables, from between a tenacity decrease of up to about 35 percent to a tenacity increase of up to about 100 percent.

Further characteristics, features and advantages of the present invention will be described and understood from a detailed disclosure of preferred embodiments of the invention set forth below.

DETAILED DESCRIPTION OF THE PREFERRED EMBODIMENTS

Those persons skilled in the relevant art will readily recognize and understand that the present invention is susceptible of quite broad utility and applicability within the art, as already indicated above, and accordingly the following detailed description of preferred embodiments of the present invention is only intended, and is to be understood, as being exemplary of possible applications of the present invention and is not made nor to be interpreted as limiting the scope or substance of the present invention. In particular, although the following exemplary embodiments of the present invention illustrate various applications in the draw warping of multiple elastane filaments simultaneously, the invention as already described is equally applicable to the so-called single end drawing of a single continuous elastane filament and the basic parameters and variables described hereinbelow with respect to draw warping embodiments of the invention should be equally applicable to single filament drawing of elastane filaments.

The field of warp knitted fabrics is a principal segment of the textile industry which utilizes elastane filaments in the production of textile fabric. As is known, the process of warp knitting, like weaving, relies upon yarns or filaments being fed in the form of a so-called warp typically supplied from a warp beam about which multiple yarns or filaments are wound in side-by-side relation to facilitate feeding of the multiple yarns or filaments in corresponding side-by-side relation collectively forming a warp sheet for delivery to a warp knitting machine. Warp knitting, like much of the modem textile industry, utilizes a substantial volume of synthetic filamentary yarns, especially polyester and nylon, which typically require drawing, and in the case of polyester heating setting, preparatory to use in the formation of textile fabrics. Thus, the now well known process of draw warping was developed as a convenient and efficient means of combining the preparatory steps of building a warp beam of multiple synthetic filaments suitable for warp knitting while at the same time performing the requisite drawing and heat setting of the filaments. In addition to the advantage of efficiency, draw warping ensures that all of the yams in a given warp beam to be utilized in the fabrication of a textile fabric have been identically prepared for the knitting process and thereby better ensures that a warp knitted fabric will have uniform physical characteristics, e.g., denier, dye affinity, etc., across the full width and length of the fabric.

When elastane filaments are to be utilized in a warp knitting fabric, it accordingly is already necessary as a preparatory step to wind multiple ends of the filaments side-by-side onto a warp beam, although conventionally no drawing, heat setting or other processing of the filaments takes place or is believed to be necessary or desirable, as already described above. Thus, one of the natural and advantageous applications contemplated for the present invention is to perform the present methodology of selectively altering the physical properties of the elastane filaments through the performance of a draw warping operation on such filaments, preparatory to warp knitting thereof.

A driven positive-feed warping creel, which is generally well known but not typically used in draw warping equipment, will generally be necessary for supplying elastane filaments in a draw warping operation in accordance with the present invention, but otherwise essentially any draw unit of any of the conventionally available and well known equipment for performing draw warping operations will be suitable for use in performing the present invention and, hence, the structure of such machinery forms no part of the present invention. One of the leading manufacturers of draw warping machinery is Karl Mayer Textilmaschinenfabrik GmbH, of Obertshausen, Germany and, by way of example, the draw units of the draw warping machinery of this company, such as the Model DSST described in U.S. Pat. No. 4,669,159, are well suited to the performance of the methodology of the present invention. Since such machines are well known, a full description and illustration of the structure and operation of such machines is not believed to be necessary to facilitate an enabling disclosure and understanding of the present invention.

Merely by way of general summary, all draw warping machines, including the specific identified machine of Karl Mayer Textilmaschinenfabrik GmbH, basically provide a series of differentially driven rollers about which a warp sheet of filaments is trained for longitudinal traveling movement so as to be subjected to longitudinal stretching of the filaments along their lengthwise extent while traveling in a so-called draw zone between the differentially driven rollers. Within such draw zone, the filaments are subjected to heat, typically by means of one or more heated platens and/or heated rolls, to elevate the filaments to a temperature above their particular glass transition temperature to facilitate molecular reorientation of the filaments and heat setting thereof.

Thus, in accordance with the present invention, a plurality of elastane filaments are similarly subjected to a drawing and heat setting operation by feeding a plurality of the elastane filaments into a draw warping machine wherein the filaments are collected side-by-side into the form of a warp sheet and travel about spaced rollers or corresponding implements differentially driven to subject the traveling filaments to a stretching operation in the longitudinal space intervening the rollers and, within such "draw zone," the elastane filaments are simultaneously passed over a heating plate or otherwise subjected simultaneously to the application of heat sufficient to elevate the filaments above their glass transition temperature, following which the filaments are quenched or otherwise cooled, typically via cooling rolls and/or air cooling, and the filaments are wound in warp-sheet form onto a warp beam for subsequent use in a warp knitting operation.

The basic fundamental effect of this process on the filaments is to set the filaments in the stretched condition, thereby correspondingly reducing the denier of each filament and its available degree of elongation in comparison to the original physical properties of the filaments, according to the degree of stretching to which the filaments are subjected within the draw zone of the draw warping machine. Unexpectedly, it has also been discovered that the tenacity of elastane filaments subjected to the methodology of the present invention may either be increased or decreased by the process in comparison to the original tenacity of the filaments, which is believed to be dependent upon various parameters of the filaments and the process, such as the particular specific chemical composition of the filaments, the methodology by which the filaments were originally created (dry, wet, reactive or melt spinning), the traveling speed of the filaments through the draw warping machine and the draw ratio and temperature to which the filaments are subjected within its draw zone, but the particular relationship between these and any other possibly relevant parameters has yet to be quantified or fully understood.

Overall, however, it has been determined through the process of developing and experimentation with the present invention that the fundamental process of drawing and heat setting of elastane filaments will typically result in a reduction of the denier of the filaments between about 10 percent and about 60 percent as compared to the original denier of the unprocessed filaments in a relaxed state, a corresponding reduction of the maximum degree of the elongation of the filaments to the point of breakage of between about 5 percent and about 50 percent as compared to the original degree of elongation of the filaments prior to processing, and an alteration of the tenacity of the filaments from a reduction in tenacity of about 35 percent to an increase in tenacity of about 100 percent as compared to the original tenacity of the filaments prior to performance of the present method.

The particular denier, elongation and tenacity values for filaments processed in accordance with the present invention will depend, as already indicated, upon the original chemical and physical properties of the filaments prior to performance of the present method and the relevant settings of the variable parameters of the draw warping operation. Although a precise mathematical relationship between these parameters has yet to be determined and may not be possible to determine precisely, the present invention fundamentally enables the physical properties of any known elastane filaments to be selectively reengineered at least through a degree of empirical experimentation with differing variables, whereby a broadly varied and potentially limitless combination of the physical properties of denier, elongation and tenacity may be achieved, often in combinations not necessarily possible to achieve through the conventional processes of manufacturing elastane filaments. In turn, therefore, textile fabrics having correspondingly unique physical and performance characteristics can be selectively designed, enabling greater flexibility in the design and manufacture of textile fabrics.

By way of example, the following chart illustrates the actual results of four differing examples of the performance of the present method with conventional commercially available elastane filaments manufactured by differing companies through differing spinning processes. In each case, the present method was performed in a draw warping operation, the settings of the variable parameters of the draw warping machinery (filament traveling speed, draw ratio between the draw rollers in the draw zone, and the temperature to which the filaments were subjected in the draw zone) being reflected in the chart. As will be seen, the alteration of the physical properties of denier, elongation and tenacity in the filaments achieved in the differing examples is reflective of the aforestated ranges achievable through the present method.

| | Example 1 | Example 2 | Example 3 | Example 4 |
|---|---|---|---|---|
| Brand of Elastane | MOBILON ™ by Nisshinbo Ind., Inc. Japan | ECOTHANE ™ by Optimer Co., USA | 280 GLOSPAN ™ by Globe Mfg. Co. USA | LYCRA ™ by Dupont de Nemours & Co. USA |
| Spinning Method | MELT SPUN | MELT SPUN | REACTION SPUN | DRY SPUN |
| DENIER (Original) | 140 | 120 | 280 | 140 |
| TENACITY (Original) (grams per denier) | 1.26 g/d | 0.77 g/d | 0.74 g/d | 0.96 g/d |
| ELONGATION (Original) | 615% | 825% | 656% | 522% |
| DRAWING SPEED (meters per minute) | 100 M/M | 100 M/M | 300 M/M | 300 M/M |
| DRAW RATIO | 1.53:1.0 | 1.8:1.0 | 1.63:1.0 | 1.63:1.0 |
| HEAT SETTING | | | | |

-continued

| | Example 1 | Example 2 | Example 3 | Example 4 |
|---|---|---|---|---|
| Brand of Elastane | MOBILON ™ by Nisshinbo Ind., Inc. Japan | ECOTHANE ™ by Optimer Co., USA | 280 GLOSPAN ™ by Globe Mfg. Co. USA | LYCRA ™ by Dupont de Nemours & Co. USA |
| TEMPERATURE (Celsius) | 130° C. | 105° C. | 160° C. | 160° C. |
| DENIER (after drawing) | 90 | 70 | 236 | 102 |
| TENACITY (after drawing) | 1.81 g/d | 1.59 g/d | 0.63 g/d | 1.14 g/d |
| ELONGATION (after drawing) | 332% | 744% | 518% | 372% |

As represented by the data in the additional chart set forth below, elastane filaments which have been warp drawn in accordance with the present invention perform essentially the same as comparable undrawn conventional elastane filaments when formed into textile fabric constructions. In particular, the following chart sets forth comparative physical data for (a) a "trial" fabric warp knitted using, among other yarns, a warp of elastane filaments warp drawn in accordance with the present invention from a starting denier of 105 to a finished drawn denier of 70; (b) a "control" fabric identically knitted using all of the same yarns in the same stitch construction as the "trial" fabric except substituting a warp of conventional undrawn elastane filaments of 70 denier; and (c) predesignated "target" specifications for the desired fabric. As the physical data compiled in the chart reflects, the "trial" fabric utilizing the drawn elastane filaments of the present invention satisfies the target fabric specifications within the same tolerance range or within a closer tolerance than the "control" fabric, fundamentally establishing that the elastane filaments of the present invention perform comparably to conventional elastane filaments but, owing to the drawing methodology of the present invention, at a reduction in fabric cost compared to that incurred using conventional undrawn elastane filaments.

| | Target Fabric Specifications | Trial Fabric | Control Fabric |
|---|---|---|---|
| Width | 60"–62" | 62" | 62" |
| Oz/sq. yd. | 3.60 | 3.63 | 3.56 |
| Courses/Inch (CPI) | 141 | 136 | 136 |
| Wales/Inch (WPI) | 41 | 42 | 42 |
| Length Stretch (lower limit-midpoint -upper limit) | 144-160-176% | 171% | 174% |
| Width Stretch (lower limit-midpoint -upper limit) | 24-34-44% | 32% | 32% |
| Shrinkage (Length × Width) | 2.0% × 4.0% | 2.7% × 4.1% | 0.6% × 2.9% |
| Length Modulus | | | |
| 20% | 0-0.20-0.40 g/d | 0.25 g/d | 0.14 g/d |
| 40% | 0.15-0.48-0.81 g/d | 0.53 g/d | 0.39 g/d |
| 60% | 0.34-0.76-1.20 g/d | 0.82 g/d | 0.63 g/d |
| 80% (lower limit-midpoint-upper limit) | 0.49-1.08-1.78 g/d | 1.17 g/d | 0.90 g/d |

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A method of selectively altering permanently physical properties of an elastane filament, comprising:

(a) stretching the elastane filament to a selected degree, and (b) during the stretching of the elastane filament, heating the elastane filament to a selected temperature above a glass transition temperature thereof for causing the elastane filament to become permanently set at a reduced denier and a reduced degree of elongation.

2. A method of selectively altering physical properties of an elastane filament according to claim 1, further comprising causing the elastane filament to travel longitudinally during the stretching and heating.

3. A method of selectively altering physical properties of an elastane filament according to claim 2, wherein the heating is applied to the elastane filament for a selected period of time.

4. A method of selectively altering physical properties of an elastane filament according to claim 3, wherein the selected time period is determined by setting a speed of longitudinal traveling for the elastane filament.

5. A method of selectively altering physical properties of an elastane filament according to claim 1, wherein the stretching and heating are performed on a single elastane filament.

6. A method of selectively altering physical properties of an elastane filament according to claim 1, wherein the stretching and heating are performed simultaneously on multiple elastane filaments.

7. A method of selectively altering physical properties of an elastane filament according to claim 6, wherein the stretching and heating are performed as part of a draw warping of multiple elastane filaments.

8. A method of selectively altering physical properties of an elastane filament according to claim 1, wherein the elastane filament is set at a denier which is reduced between about ten percent (10%) and about sixty percent (60%) of its original denier prior to stretching and heating.

9. A method of selectively altering physical properties of an elastane filament according to claim 1, wherein the elastane filament is set at a degree of elongation which is reduced between about five percent (5%) and about fifty percent (50%) of its original degree of elongation prior to stretching and heating.

10. A method of selectively altering physical properties of an elastane filament according to claim 1, wherein the elastane filament is set at a tenacity which is increased from its original tenacity prior to stretching and heating.

11. A method of selectively altering physical properties of an elastane filament according to claim 1, wherein the elastane filament is set at a tenacity which is decreased from its original tenacity prior to stretching and heating.

12. A method of selectively altering physical properties of an elastane filament according to claim 1, wherein the elastane filament is set at a tenacity which is increased between about zero percent (0.0%) and about one hundred percent (100%) from its original tenacity prior to stretching and heating.

13. A method of selectively altering physical properties of an elastane filament according to claim 1, wherein the elastane filament is set at a tenacity which is decreased between about zero percent (0.0%) and about thirty-five percent (35%) from its original tenacity prior to stretching and heating.

14. An elastane filament produced according to the method of claims 1, 4, 5 or 7.

15. A method of selectively altering permanently physical properties of an elastane filament, comprising:

(a) causing the elastane filament to travel longitudinally;

(b) during the traveling of the elastane filament, stretching the elastane filament to a selected degree less than its full degree of elongation; and (c) during the stretching of the elastane filament, heating the elastane filament to a selected temperature above a glass transition temperature thereof for a selected time period;

(d) the selected degree of stretching, the selected temperature and the selected time period being predetermined in relation to one another for permanently setting the elastane filament at a selectively reduced denier and a selectively reduced degree of elongation.

16. A method of selectively altering physical properties of an elastane filament according to claim 15, wherein the selected time period is determined by setting a speed of longitudinal traveling for the elastane filament.

17. A method of selectively altering physical properties of an elastane filament according to claim 15, wherein the stretching and heating are performed on a single elastane filament.

18. A method of selectively altering physical properties of an elastane filament according to claim 15, wherein the traveling, stretching and heating are performed on multiple elastane filaments simultaneously as part of a draw warping of the multiple elastane filaments.

19. A method of selectively altering physical properties of an elastane filament according to claim 15, wherein the elastane filament is set at a denier which is reduced between about ten percent (10%) and about sixty percent (60%) of its original denier prior to stretching and heating.

20. A method of selectively altering physical properties of an elastane filament according to claim 15, wherein the elastane filament is set at a degree of elongation which is reduced between above five percent (5%) and about fifty percent (50%) of its original degree of elongation prior to stretching and heating.

21. A method of selectively altering physical properties of an elastane filament according to claim 15, wherein the elastane filament is set at a tenacity which is increased from its original tenacity prior to stretching and heating.

22. A method of selectively altering physical properties of an elastane filament according to claim 15, wherein the elastane filament is set at a tenacity which is decreased from its original tenacity prior to stretching and heating.

23. A method of selectively altering physical properties of an elastane filament according to claim 15, wherein the elastane filament is set at a tenacity which is increased between about zero percent (0.0%) and about one hundred percent (100%) from its original tenacity prior to stretching and heating.

24. A method of selectively altering physical properties of an elastane filament according to claim 15, wherein the elastane filament is set at a tenacity which is decreased between about zero percent (0.0%) and about thirty-five percent (35%) from its original tenacity prior to stretching and heating.

25. An elastane filament having permanently altered physical properties produced according to the method of claims 15, 16, 17 and 18.

* * * * *